US005441066A

United States Patent [19]

Harris

[11] Patent Number: 5,441,066

[45] Date of Patent: Aug. 15, 1995

[54] PORTABLE UNIVERSAL SUNSHADE FOR BOATS

[76] Inventor: Norman E. Harris, 1000 Bear Island Dr., West Palm Beach, Fla. 33409

[21] Appl. No.: 262,761

[22] Filed: Jun. 17, 1994

Related U.S. Application Data

[63] Continuation of Ser. No. 871,124, Apr. 20, 1992, abandoned.

[51] Int. Cl.[6] ..... E04H 15/06

[52] U.S. Cl. ..... 135/88.01; 135/98

[58] Field of Search ..... 135/90, 98, 99, 112, 135/16, 119, 33.4, 33.5, 31, 20.3, 33.2, 88

[56] References Cited

U.S. PATENT DOCUMENTS

| | | | |
|---|---|---|---|
| 1,431,775 | 10/1922 | Cannon et al. | 135/33.4 |
| 2,325,645 | 8/1943 | White | 135/98 |
| 2,628,797 | 2/1953 | Campomar | 135/98 X |
| 2,714,387 | 8/1955 | Meldrum | 135/106 X |
| 2,769,451 | 11/1956 | Edgin | 135/109 |
| 2,847,019 | 8/1958 | Ogle, Sr. | 135/106 X |
| 3,850,186 | 11/1974 | Weber et al. | 135/20.3 |
| 4,086,931 | 5/1978 | Hall | 135/99 X |
| 4,433,699 | 2/1984 | Schultes et al. | 135/98 X |
| 5,152,495 | 10/1992 | Jacinto et al. | 135/98 X |

FOREIGN PATENT DOCUMENTS

| | | | |
|---|---|---|---|
| 2337177 | 4/1975 | Germany | 135/16 |
| 726646 | 3/1955 | United Kingdom | 135/99 |

*Primary Examiner*—Lanna Mai

*Attorney, Agent, or Firm*—Malin, Haley, DiMaggio & Crosby

[57] ABSTRACT

A portable sunshade that can be universally mounted for protection from intense sun rays or other weather elements that is especially suited for boats or open vehicles such as truck beds, comprising an opaque flexible canopy to provide shade, an umbrella-like frame of support members that can be opened to a first position and collapsed to a second position, an adjustable central pole for adjusting the central support member in height, a cushion mounted at the base of the support pole, and a plurality of tie-downs and fasteners for affixing the sunshade to a plurality of locations, each of the tie-downs being adjustable in length for proper tensioning on the central support pole. The device can also be used in other outdoor environments such as for hunting, fishing, camping or the beach.

11 Claims, 3 Drawing Sheets

PORTABLE UNIVERSAL SUNSHADE FOR BOATS

This application is a continuation of application Ser. No. 07/871,124, filed Apr. 20, 1992 now abandoned.

BACKGROUND OF THE INVENTION

1. Field of the Invention

This invention relates to portable sunshades and in particular, to a lightweight, easily transportable sunshade that can be used in a variety of locations including boats, truck beds, docks, camping, and beaches. This sunshade is usually for temporary not permanent use and is easily installed and removed.

2. Description of the Prior Art

Sunshades, especially as used on boats, are known in the prior art. Many boats have collapsibly movable convertible tops that in essence are constructed of a canvas cover and metal frames permanently mounted to the boat which permit use in a single location on the boat for protection against sun or rain. Usually, a single top covers only a small portion of the available deck space. Portable shelters have been known as shown in U.S. Pat. No. 4,793,371 which describes a conventional rigid frame with a fabric covering. Such shelters tend to be bulky, are truly not portable, and cannot be adjustably set up in a variety of different locations.

U.S. Pat. No. 4,781,411 shows a portable sunshield that is attached to a boat chair, having rigid frame members not readily adapted to other environments. U.S. Pat. No. 2,689,579 shows a collapsible canopy structure not adaptable for different environments.

The present invention provides an adaptable, portable sunshade that can be used in boats, open bed trucks, and numerous other environments, and has adjustability in height and a plurality of adjustable straps that can be conveniently anchored in numerous fastener connections so that the device can be easily installed and removed and stored.

SUMMARY OF THE INVENTION

A portable sunshade comprising a telescopically adjustable stabilizing pole, a resilient pad connected to the base of the pole, offering a resilient cushioned support on the end of the pole, a flexible polyester fabric sheet opaque to block the sun's rays, having a central portion attached to the pole, a plurality of foldable ribs, connected to the flexible sheet, movably mounted to the pole which can be moved from a closed position parallel to the pole to an open position approximately 90° to the pole, and a plurality of fasteners, each connected at a predetermined position on the fabric sheet, and a plurality of adjustable tie down or tension straps (preferably made of nylon fabric) connectable to the fasteners attached to the sheet.

The flexible sheet is the sun shade canopy and is typically a polyester fabric-like sheet of material and in the preferred embodiment may be a 6 ft. by 6 ft. square. The center of the fabric sheet is connected to a pole connector at the top end of the pole. The plurality of ribs are attached to a sleeve (runner) mounted on the pole which has a stop or spring-actuated button to hold the rib frame in the open position. The ribs expand against the fabric sheet to hold it open as a canopy.

A plurality of D-ring fasteners are attached by nylon sleeves at the square corners of the fabric sheet. Each nylon sleeve that receives the end of one of the rigid primary ribs for holding the sheet firmly in place, relative to the ribs.

The nylon tension straps are adjustable in length and have spring-activated clip fasteners, at one end, which attach to D-rings on the fabric sheet perimeter and a separate second D-ring fastener at the other end of the strap to anchor each strap on a boat fixture or other object. This allows for great flexibility in attaching each nylon strap to the environment such as on a boat where the nylon straps could be attached to cleats or wrapped around other protrusions so that literally, the sunshade can be anchored under strap tension anywhere on a boat.

The center support pole is telescopic and includes two rigid tubes, one inside the other, and a tube friction lock which allows the pole to be adjusted in length, thereby allowing the shade height to be varied and mounted almost anywhere. The base of the pole includes a cushion or pad so that the pole can be supported on any surface without damaging the surface.

Since there is only the single adjustable center pole, the sunshade is primarily for temporary use, is portable and when collapsed with the ribs, can be stored much like an umbrella.

As a typical use, the portable sunshade may be set up on a small boat having an open cockpit. The center pole is telescopically moved to its full extension position and the nylon straps are clip fastened to the D-rings at the end of each corner of the fabric sheet constituting the sunshade canopy. The opposite ends of the straps may be then attached to cleats or if necessary, to other hooks or protrusions oh the boat where convenient, so that all four straps are pulled in tension which firmly holds the support pole in place from all sides. The straps are anchored to provide competing tensions in opposite directions (from all four corners) for maximum support tension. When it is time to remove the sunshade, one merely releases the fasteners holding the nylon straps, lowers the flexible rib array, and the sunshade is ready for storage.

It is an object of this invention to provide a lightweight, portable sunshade for use with vehicles such as boats, open truck beds, campers, or on the beach, which is easily portable, lightweight, and low cost in manufacture.

It is another object of this invention to provide a sturdy, portable sunshade that has an adjustable height and can be mounted in a plurality of environments such as boats, truck beds, docks, and includes a plurality of flexible anchor lines which are attached to the fabric itself for tensioning the device when in place.

And yet still another object of this invention is to provide a mildew resistent sunshade having an adjustable pole and straps that can be used on almost any vessel from a fishing boat to a yacht that is simple to install and remove and fits in numerous different locations on various size boats.

In accordance with these and other objects which will become apparent hereinafter, the instant invention will now be described with particular reference to the accompanying drawings.

PREFERRED EMBODIMENT OF THE INVENTION

Figures 1, 6:
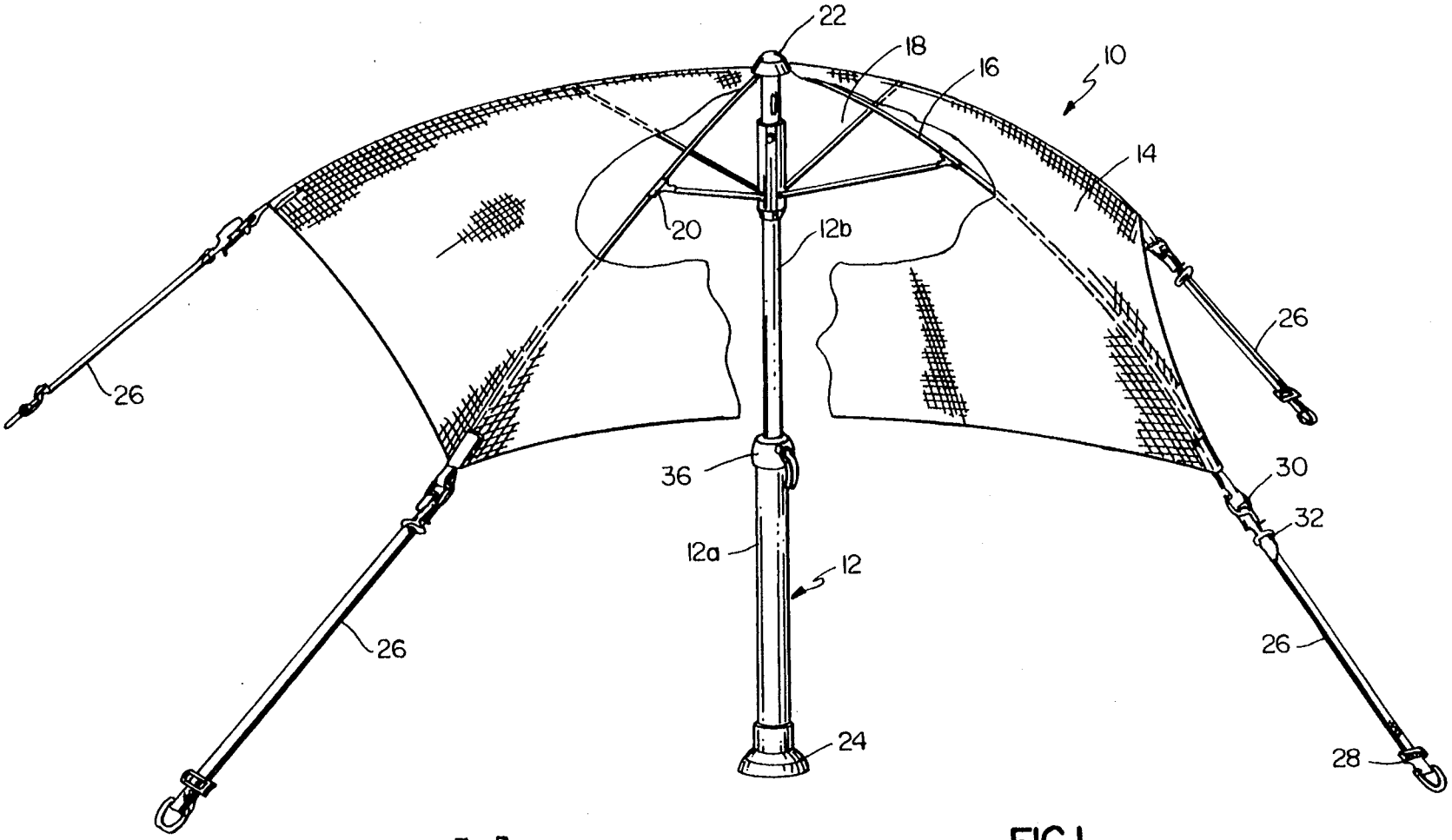
FIG. 1 shows a perspective partially cut away view of the present invention.
FIG. 6 is a lateral cross sectional view of the paragon steel first rib and secondary rib section.

Referring now the drawings and in particular, FIG. 1, the present invention is shown generally at 10 comprised of a flexible polyester sheet 14 which is fabric-like in nature and acts as a sunshade and sunscreen attached at corners 14*a* to a plurality of primary structural support ribs 16 and in the center to a top cap 22 firmly affixed to a central support member 12. Each of the flexible sheet corners 14*a* further include connectors 30 which are D-rings that can be readily attached to removable fasteners 32, each attached to a nylon flat strap 26. As shown in FIG. 1 the fabric sheet 14 is cut away to expose the primary rib and secondary rib structures, much like an umbrella, that allows the canopy flexible sheet 14 to be extended to the up position as shown or to a closed position substantially parallel to the center support member 12.

The center rigid support 12 is actually two rigid metal or plastic tube 12*a* and 12*b* which are telescopically and concentrically mounted so that the smaller diameter conduit support 12*b* fits within the inner radius of 12*a* support member. A cam-actuated stop allows for adjustment longitudinally of the central support member 12 which in effect firmly clamps segment 12*b* at a particular longitudinal position relative to segment 12*a* in the locked position as shown. The adjustable height is an important feature of the invention for universally mounting the sunshade virtually anywhere. Tie-down straps can be adjusted for tension to particular fasteners. To support the central support member at its bottom or lower end, a foot cushion 24 which can be made of soft vinyl plastic or rubber is attached to protect any surface that the central support member 12 is supported on.

The primary and secondary rib structures are constructed of at least four paragon metal U-shaped ribs 16 which start at top 22 and are pivotally mounted to the upper end of support member 12*b* and extend downwardly to the corner edge 14*a* of the fabric canopy 14. In this embodiment, the canopy is actually square and each corner 14*a* has in addition to the fabric of the canopy 14 a nylon reinforcing sleeve at the tip that receives the end of rib 16 in a pocket much like a cylindrical pocket so that the end of rib 16 is firmly affixed to canopy 14 without tearing the canopy. In addition, the nylon reinforcement sleeve also is sewn and attached to fasteners such as D-rings which are discussed below. The secondary ribs 18 are pivotally attached to the primary ribs 16 by connectors 20 and are also pivotally attached to a sleeve 44 that can, by a locking means, be locked in a fixed position relative to support segment 12*b* in the open position. This keeps the canopy sheet 14 in an open position when desired while allowing the sleeve to move along support member 12*b* segment to collapse the entire device for portability.

Figure 2:
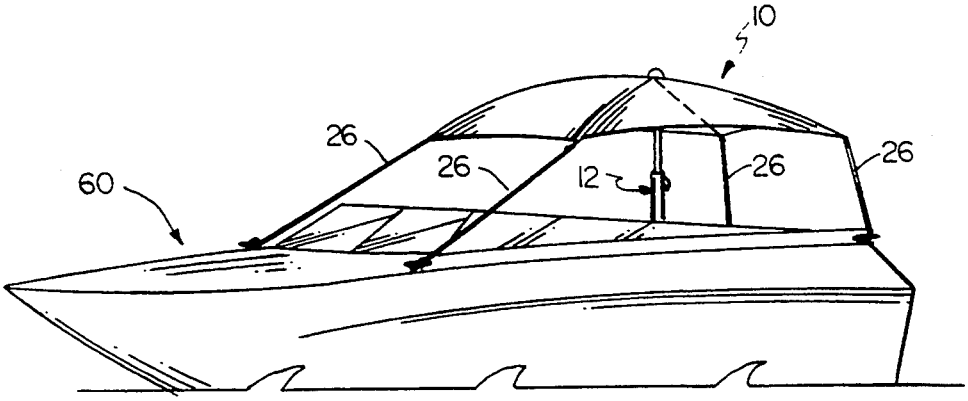
FIG. 2 shows a perspective view of the invention as used on an open cabin speedboat.

FIG. 2 shows a typical mount with the support shaft 12 located inside the open cockpit of a boat 60 and the nylon strap tie-downs 26 tensioned to firmly hold the entire device 10 in place for providing sunshade or weather protection within the cockpit of the boat.

Figure 3A:
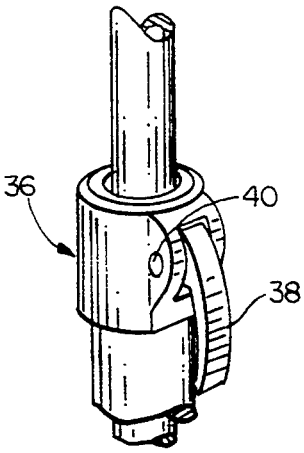
FIG. 3A shows a perspective partially cut away view of the telescopic pole used with the present invention.
Figure 3B:
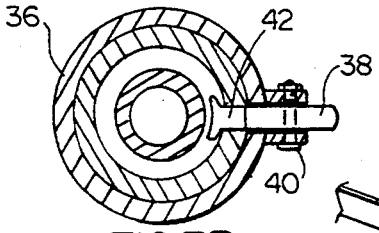
FIG. 3B provides a top plan view in cross section of the pole view of FIG. 3A.
Figure 3C:
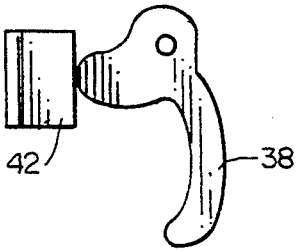
FIG. 3C shows a perspective view of a cam actuating lock used to lock the pole in an adjustable position.

Referring to FIGS. 3A, 3B and 3C, the cam-actuated clamp mechanism is shown that allows the central support member to be adjusted longitudinally to any desired position for supporting the entire canopy. For example, as shown in FIG. 3A, the smaller diameter shaft 12*b* fits inside the larger diameter shaft 12*a* for the central support member. A pressure (friction) clamping device 36 fits like a sleeve around an outside portion of member 12*a* and includes a cam-shaped clamp arm 38 which pivots about a pin 40 mounted in the clevis structure of sleeve 36. The cam surface on arm 38 contacts a clamping member 42 mounted through an aperture in support member 12*a* that can create a friction lock when the cam surface (see FIG. 3C) 38*a* pushes against the locking member 42 which moves and forms a friction lock on the inner segment 12*b*. When the clamping member 38 is raised approximately 90° from the position shown in FIG. 3A, it can be seen that the clamping member 42 has sufficient space to move outwardly radially away from the exterior surface of segment 12*b*, thus freeing segment 12*b* for longitudinal movement telescopically relative to segment 12*a*. Thus the support height of the canopy can be dramatically varied This allows for use in many places that can receive the sunshade.

Figure 4:
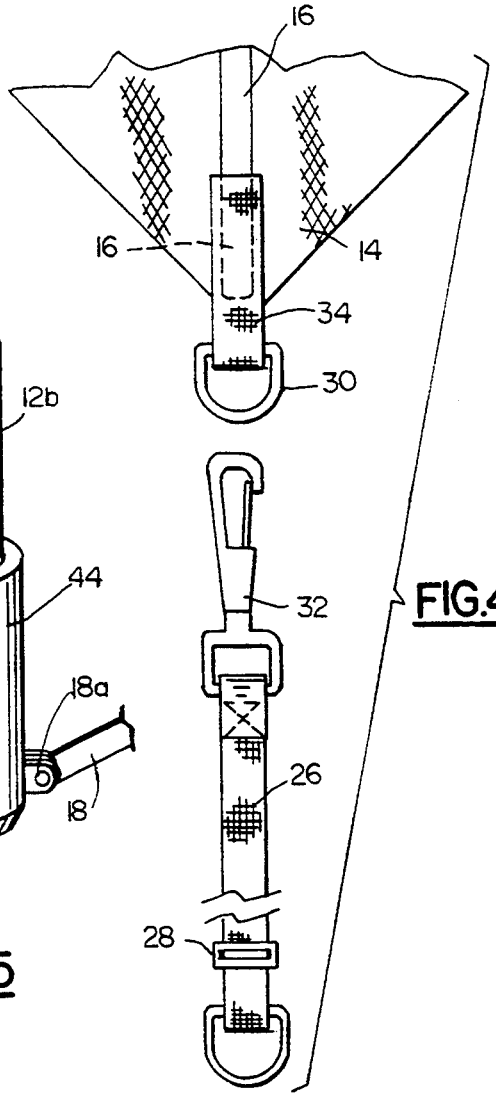
FIG. 4 shows a top plan view of an end quarter of the fabric sheet used with the present invention including the nylon socket for the ribs, an adjustable anchor strap, and a clip fastener used with the present invention.

Of equal importance is the fact that the portable shade is lightweight through the use of lightweight materials such as paragon ribs, the tie-down nylon straps and lightweight fasteners. By permitting multiple adjustable straps of varying length and configuration for attachment to existing objects in the local area of where the sunshade is to be mounted, the entire unit has great flexibility as to its positioning. Referring to FIG. 4, one can see that the D-ring 30 is attached to the nylon sleeve 34 that is sewn to a corner edge of sheet 14 with the nylon sleeve 34 receiving the lower end of one of the primary support ribs 16. A D-ring, which is a metal ring 30, is also sewn and attached by the nylon strip 34 at the corner edge. A flexible clip fastener 32 is used to attach through a spring-loaded mechanism to the D-ring 30 and has nylon strap 26 attached thereto with a strap adjustment 28 for changing the length of the strap. Attached at the opposite end of strap 26 is another D-ring 62. With the D-ring fasteners 30 and 62, the adjustable nylon straps 26 used for tie-downs and the spring-loaded clip fasteners 32, the great flexibility of the unit can be seen. For example, nylon strap 26 can be looped through existing clamps or cleats on a boat surface or on any appendage. In addition, a strap can be looped through a D-ring 62 so that it can be adjusted in length to fit almost anywhere. Also, once a strap is adjusted in length, it can be used again and again at the same location.

Figure 5:
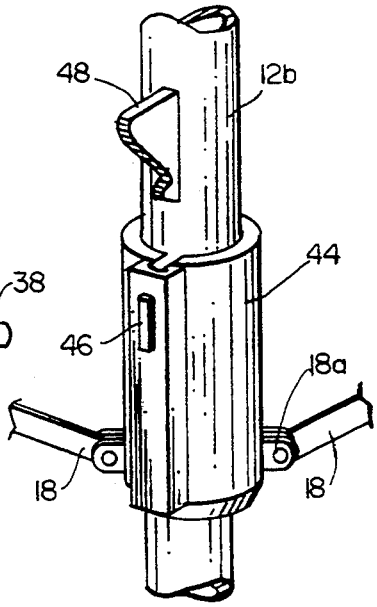
FIG. 5 shows the rib structure actuating mechanism used on the pole with the present invention.

Referring now to FIG. 5, the central sleeve 44 which has a U-shaped channel 44*a* to receive a spring-mounted clip 48 positioned and mounted within center support segment 12*b* is provided so that the framework of the secondary ribs 18 and which is pivotally attached at 18*a* to sleeve 44 can be locked in an open position such that the spring clip 48 is received within U-shaped channel 44*a* below the sleeve 44. When it is time to collapse the canopy, a movable button 46 pushes down on the spring clip 48, releasing the sleeve 40, allowing it to more longitudinally, relative to the central support segment 12*b*.

FIG. 6 shows the cross sectional shape of the primary support rib 16 which are paragon steel which also are the shape of the secondary support ribs 18 which greatly reduce the weight, making the device more portable.

Figure 7:
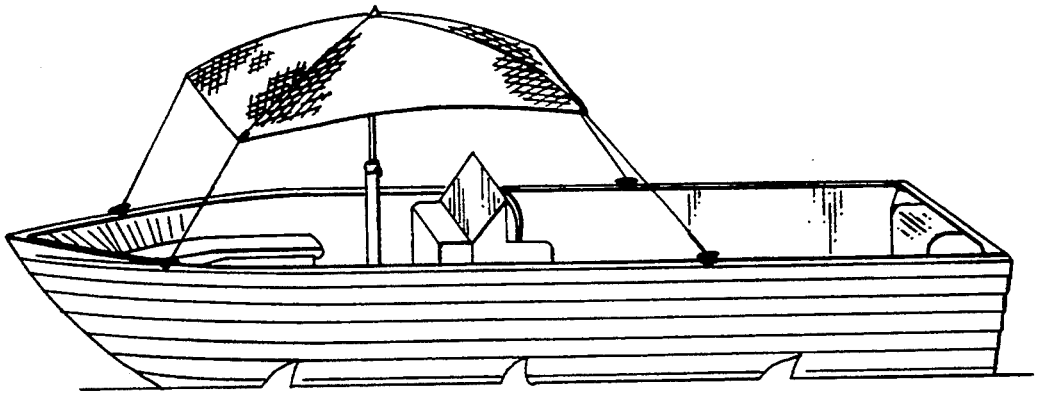
FIG. 7 is a perspective view of the invention used on the bow of the boat shown in FIG. 2.

FIG. 7 shows how versatile the sunshade is by having the device 10 mounted on the bow 72 of the vessel 70 that is quite different than the vessel shown in FIG. 2. This can be accomplished by the versatility in changing the length of the support member and the universal adjustment of all the straps which hold the entire device in tension firmly in position with the universal fasteners allowing the tie-down straps to be supported anywhere.

Not only does the device have tremendous universal adaption for use in boats and pickup truck beds which allow people to experience sunshade while sitting in a truck bed for outdoor activities such as fishing or the like, the device can also be used for hunting and in such embodiment as shown in FIG. 1, panels can be made with clear plexiglass to allow certain window openings as protection against the elements when total sun protection is not necessary. Typically, hunting is done in the winter and the elements such as rain are paramount for protection. Also, the device could be used camping with the addition of ground imbedded stakes that could be attached to the tie-downs to allow someone to be positioned beneath the sunshade on the ground.

Although in the preferred embodiment, a square canopy is desirous for universal fit, the canopy could be changed in its peripheral configuration or shape for specific environments.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A portable, universally mountable sunshade for boats comprising:

a boat having means for attachment disposed thereon;

a flexible opaque sheet having a peripheral edge, said sheet capable of sun ray blockage to provide shade;

a plurality of primary arcuate support ribs;

a rigid, elongated central support member positioned substantially at the center of said sheet, having an upper end and a lower end, said support member being adjustable longitudinally in length, said primary support ribs each having an inner end and an outer end, each primary support rib pivotally connected at its inner end to said rigid support member adjacent said rigid support member upper end and to said flexible sheet at each outer end;

a movable sleeve connected to said rigid support member;

a plurality of secondary ribs, each secondary rib having a first end and a second end, each first end pivotally connected to said sleeve and each second end pivotally connected to one of said primary ribs;

at least two fasteners attached to predetermined positions of said flexible sheet periphery;

at least two flexible straps, each strap having a first end and a second end, each strap first end connected to one of said fasteners, each strap second end connected to said boat means for attachment, each of said straps being adjustable in length for providing a pulling force at said sheet periphery and for supporting said primary support ribs and said sheet in a fixed position; and cushion means attached to the lower end of said central support member for providing a cushion support to said central support member, whereby said sunshade is capable of being mounted in a fixed position in different locations through the combined adjustment of the vertical support member in length and adjustment of the tie-downs and fasteners.

2. A portable universal sunshade as in claim 1, wherein:

said straps are length-adjustable and include second fasteners attached at each end of said straps.

3. A portable universal sunshade as in claim 1, wherein:

said flexible sheet is essentially square in its configuration.

4. A portable universal sunshade as in claim 3, including:

at least four tie-down straps;

at least four D-rings, each attached to a corner of said flexible sheet;

spring-loaded fasteners attached at one end to said straps and attachable to each of said D-rings attached to said flexible sheet; and secondary D-rings attached at the free ends of each of said straps, whereby said sunshade can be adjustably mounted in numerous different locations by adjusting the central member and the length of the supporting straps.

5. A portable universal sunshade as in claim 1, wherein:

said flexible sheet is made of an artificial fiber such as polyester.

6. A portable universal sunshade as in claim 1, including:

a fabric sleeve attached to strategic locations on said sheet, said fabric sleeve sized to receive the ends of said primary ribs for firmly attaching the ends of the primary ribs to said flexible sheet.

7. A portable universal sunshade as in claim 6, including:

a D-ring connected to said fabric sleeve attached to said sheet.

8. A portable universal sunshade as in claim 1, wherein:

said support member includes a first central support member and a second central support member, telescopically attached to said first central support member; and means for frictionally locking said first central segment to said second central segment at any position longitudinally for adjusting the longitudinal length of the central support member.

9. A portable universal sunshade as in claim 8, wherein:

said locking means includes a cam-actuated trigger; and a friction pressure plate, movably adjustable against said second telescopic support member when actuated by said cam trigger mechanism.

10. A portable universal sunshade as in claim 1, wherein:

said primary and secondary rib supports and said central support member constituting a canopy support frame that can be raised to an expanded first position substantially perpendicular to the central support member and a collapsed position substantially parallel to the central support member; and means for locking said frame in a first expanded position and for releasing said frame for movement to said collapsed position.

11. A portable universal sunshade as in claim 1, wherein: said primary and secondary support ribs are substantially U-shaped in lateral cross section for reduced weight to make the sunshade more lightweight for portability.

* * * * *